United States Patent [19]

Gordon et al.

[11] Patent Number: 5,013,263

[45] Date of Patent: May 7, 1991

[54] MODULAR ELECTRICAL CONNECTOR STRUCTURE

[76] Inventors: William Gordon, 8 Maple La., Mine Hill, N.J. 07801; Mark A. Minter, 10 Maple Ave., Newton, N.J. 07860

[21] Appl. No.: 96,800

[22] Filed: Sep. 11, 1987

Related U.S. Application Data

[63] Continuation of Ser. No. 800,805, Nov. 22, 1985, abandoned.

[51] Int. Cl.[5] ..... H01R 13/00

[52] U.S. Cl. ..... 439/630

[58] Field of Search ..... 439/59, 492, 493, 495, 439/496, 629, 630, 631, 632, 634, 715, 717

[56] References Cited

U.S. PATENT DOCUMENTS

| | | | |
|---|---|---|---|
| 3,016,508 | 1/1962 | Lalonde | 339/176 MP |
| 3,399,372 | 8/1968 | Uberbacher | 339/176 MP |
| 3,516,046 | 6/1970 | Gettig | 339/176 MP |
| 3,848,221 | 11/1974 | Lee, Jr. | 339/176 MP |
| 4,269,470 | 5/1981 | Ustin | 339/198 H |
| 4,468,073 | 8/1984 | Machcinski | 339/176 MP |
| 4,530,561 | 7/1985 | Tyree et al. | 339/176 MP |

*Primary Examiner*—Joseph H. McGlynn

*Attorney, Agent, or Firm*—Donald P. Gillette

[57] ABSTRACT

This invention relates to modular connector structures that are shaped to receive the edges of printed circuit boards and that have contacts spaced a unit distance apart so that they can engage, separately, each of the contact pads, or fingers, spaced apart by the same unit distance along the surfaces of the boards. In particular, it relates to connector structures that have conversely shaped interlocking parts at their ends to interlock end-to-end with similar structures to form a substantially self-supporting connector that can have any desired number of contacts, each spaced an integral multiple of the same unit distance from all of the contacts on all of the modules.

21 Claims, 2 Drawing Sheets

43 41 42 44 43 41 36 43 34a 11 28 42a 44a 43a 41a 37 42 44 43 41 30
44
29
42
42
22a
22c
33b
25
22b
22d
16 23 17 24 33a 44 41 33 34b 18 19 Y X Z 27 20

31 12 38 13 25 18 26 3 39 27 20 32
14
30
29
23
24
22c,22d
16 46 17 22 46 19 46 22a,22b 62 46
3

12
13 13
28
72a 72b
57a 57b
34a 34b
50a 49a 50b
48a 22b
52a 54a 55b
54b 53b
53a 48b
22a 55a 49b
48a 58b
19 46 56b 62 47
63a 56a 59 63b
45a 61a 45b
61b 50
52
49
54
55
48
49
22e
53
58
64 67
45
47
65 63
66

50
52
48
49
55 54 22f
53
58
69 68 69
71

MODULAR ELECTRICAL CONNECTOR STRUCTURE

This application is a continuation, of U.S. application Ser. No. 800,805, filed Nov. 22, 1985, now abandoned.

BACKGROUND OF THE INVENTION

This invention relates to modular connector structures that are shaped to receive the edges of printed circuit boards and that have contacts spaced a unit distance apart so that they can engage, separately, each of the contact pads, or fingers, spaced apart by the same unit distance along the surfaces of the boards. In particular, it relates to connector structures that have conversely shaped interlocking parts at their ends to interlock end-to-end with similar structures to form a substantially self-supporting connector that can have any desired number of contacts, each spaced an integral multiple of the same unit distance from all of the contacts on all of the modules.

U.S. Pat. No. 3,340,440 of Jerry B. Minter describes a connector, or clip, made of round, resilient wire bent in M-shaped configuration with a U-shaped central part into which the edge of a printed circuit board can be smoothly inserted. The sides of the U-shaped central portion are formed so that they are closest together at a location that is a little distance away from the bight that defines the central bottom of the U. The distance between the side members at the region of closest approach is a little less than the thickness of the printed circuit board so that a small part, called a contact area, of each side member will press firmly against the printed circuit board to maintain good mechanical engagement with the board and good electrical connection with a finger printed at that location along the edge of the board. Because the wire is round and is curved at the contact areas, the surface configuration of each contact area is essentially spheroidal, although of very small lateral extent. The smoothness of the curvature in all directions allows the board to be slid into position without scratching off the metal that forms the contact finger at that location, yet the small lateral extent of the contact area concentrates the resilient force upon the finger to a large number of newtons per square centimeter, which is sufficient to wipe away contamination that may have accumulated on the contact area of the wire or on that part of the finger engaged by the wire.

The most popular configuration of the clips in U.S. Pat. No. 3,340,440 is M-shaped, with the U-shaped portion at the center, and the ends of the sides curved back in the opposite direction and extending parallel to each other far enough beyond the bight of the U-shaped portion to be able to fit into correspondingly spaced holes in a support member. The support member is normally another printed circuit board and is frequently called a mother board. The printed circuit board that fits into the U-shaped portion and is thus supported by the mother board is frequently referred to as a daughter board. One of the advantages of the M-shaped clip is that any desired number of them can be supported in a pair of parallel rows of holes in a mother board to engage the same number of contact pads, or fingers, along the edge of a daughter board. The clips are held in place by being soldered to pads surrounding each of the holes on the mother board. Unlike other printed circuit board receptacle connectors that are made in standard sizes having only certain numbers of contacts supported in a molded plastic trough, a connector formed only by the wire clips would not have the extra weight nor occupy the extra volume of the plastic trough nor would it have more contacts than necessary.

The individual M-shaped clips do require somewhat delicate and careful handling when their two parallel ends are being inserted into the proper holes in the mother board. To overcome that problem, another Minter U.S. Pat. No. 3,940,849, provides a method of handling the clips by means of a carrier in which a number of clips can more easily be placed in alignment so that they can all be inserted simultaneously in the mother board. The carriers may be placed end to end to allow any number of clips to be mounted on the mother board at one time, but the carriers must be removed after the clips have been soldered in place. The reason is that each carrier has a central wall that occupies the space that will later be occupied by the daughter board.

The fact that both sides of the U-shaped central portion of the M-shaped clip firmly engage the daughter board means that such clips cannot be used with daughter boards that have fingers on both surfaces adjaent the same edge if, as is frequently the case, the fingers on one surface are supposed to be electrically isolated from those on the opposite surface. To overcome that problem, Minter has described and claimed in his copending U.S. patent application Ser. No. 596,096 clips that are not M-shaped but are more or less J-shaped.

A problem common to all multi-contact printed circuit board edge connectors is that, in order to establish satisfactory electrical connection, each contact must exert sufficient pressure on the respective finger of a printed circuit daughter board, but that pressure causes frictional drag during insertion and removal. As a result, a very high force may be required to insert into the connector a daughter board that has a large number of contact fingers.

To reduce the insertion force, Minter U.S. Pat. No. 4,327,955 describes a structure in which each M-shaped clip, or each pair of clips referred to in that patent as U-shaped is placed in a depression in one surface of a wafer made of insulating material that has a certain overall front-to-back thickness. A multi-contact connector to receive the edge of a daughter board can then be made by assembling a stack of such wafers coresponding in number to the desired number of contacts and then clamping the stack together Each wafer has two channels through it to permit two rods to be pushed therethrough to engage all of the enclosed clips. These rods reduce insertion force by either forcing the clips away from the path of an incoming daughter board until it is in place or by pressing the clips against the daughter board after it is in place in the connector.

A problem that is not immediately obvious with a stack of wafers, each holding only a single contact layer consisting of a single M-shaped clip or a pair of the U-shaped clips arranged in mirror image fashion, is that the thickness of the wafers is not precisely the same from wafer to wafer, and since the thickness determines the spacing between successive contact layers, it is possible for a batch of wafers that are very slightly too thick to create a cumulative error that will cause one or more contacts at the far end of the stack not to engage the proper finger. The possibility of such an error places too low a limit on the maximum number of wafers that can be stacked together. In addition, the only thing holding the stack together is a clamp; there are no conversely shaped interlocking parts on opposite ends of each wafer to allow them to be held together as a self-supporting multi-contact connector.

OBJECTS AND SUMMARY OF THE INVENTION

It is one object of this invention to provide a modular electrical connector structure suitable for making contact with fingers spaced a unit distance apart along one edge of a printed circuit board, each such module having conversely shaped interlocking parts at its opposite ends and having accurately spaced bearing surfaces, whereby two or more such modules can be interlocked together to form a connector with as many contacts as desired, each spaced an integral multiple of the unit distance apart, whether they are on the same module or different modules.

Another object is to provide a modular electrical connector structure in which the contacts are arranged to make individual electrical contact with isolated fingers on opposite surfaces of the printed circuit board.

Still another object is to provide modular electrical connector structures having different numbers of contacts to permit a connector to be assembled that has any desired number of contacts with only a limited number of modules.

A further object is to provide a modular electrical connector structure in which each resilient wire contact may be easily inserted and will be securely held, and in which the conversely shaped interlocking parts at each end permit easy and positive assembly of two or more such modules into a substantially self-supporting connector.

Further objects will be apparent from the following description and the drawings.

In accordance with this invention, a modular structure is provided that includes an insulating support member and a plurality of contacts inserted in contact slots spaced a unit distance apart in the longitudinal direction of the module. The support member has conversely shaped interlocking means at its longitudinal ends to permit two or more such modules to be linked together into an elongated, multi-contact connector that is substantially self-supporting, even before it is attached to a more permanent support. The insulating member has two side walls that are thick enough to have contact slot in them to receive the resilient wire contacts and are spaced far enough apart to receive a printed circuit board or the like between them. The contact slots communicate with the central space, which is referred to as a connector-receiving slot, or a main slot, and each wire contact has a part that protrudes into the main slot to engage contact fingers along the surface of the inserted printed circuit board adjacent one edge thereof. The depth of the main slot, which determines the extent to which the printed circuit board can be pushed into it, is, in turn, determined by bridging means, such as a bottom wall that joins the bottom edges of the side walls together, thus giving the module a U-shaped cross section when viewed along its longitudinal direction from one end.

It is important that there be bearing surfaces, or gauging surfaces, at each end or at least facing in opposite longitudinal directions and that the longitudinal distance between one bearing surface and the nearest contact to it, but spaced from it in the direction toward the other end, plus the distance from the other bearing surface to the contact nearest to it and spaced from it in the direction toward the far end be integrally related to the unit distance between adjacent contacts. Maintaining those dimensions makes it possible for the longitudinal distance between any two contacts, whether on the same module or different, interlocked modules, to be spaced apart by an integral multiple of the unit distance.

The wire clips are securely, but not tightly, held in the contact slots, and they are generally U-shaped having a longer side and a shorter side joined together by a rounded bight. The longer side is slightly bowed to protrude into the main slot when the clip is in its respective contact slot. The uppermost end of the contact slots stops short of the upper surface of the insulating support member so that the contacts can only be inserted a specific distance into the contact slots. Other interior surfaces defining each contact slot hold the respective clips so that the longer ends of all of them extend from the lower part of the support member in neat alignment to be soldered to aligned pads on a mother board or the like. The latter ends of the clips may extend straight from the bottom end of the respective contact slot or they may be offset so that pairs of such ends can fit directly into parallel rows of holes spaced closer together than would be possible if the ends of the clips were not offset. As another alternative, the longer ends may be bent out to be flush with the top surface of the mother board to be soldered directly thereon.

The conversely shaped interlocking means at opposite ends are preferably slides and recesses therefor, both the slides and the recesses extending across the ends of the insulating support members in a direction perpendicular to the longitudinal direction of the insulating support members but being limited in length so that the slide on each insulating support member cannot pass through the recess in another such member but will be restricted so that maximum insertion of the slide into the recess will cause all of the side, top, and bottom surfaces and, particularly the main slots, of the interlocked modules to be accurately aligned with each other.

DETAILED DESCRIPTION OF THE INVENTION

Figure 1:
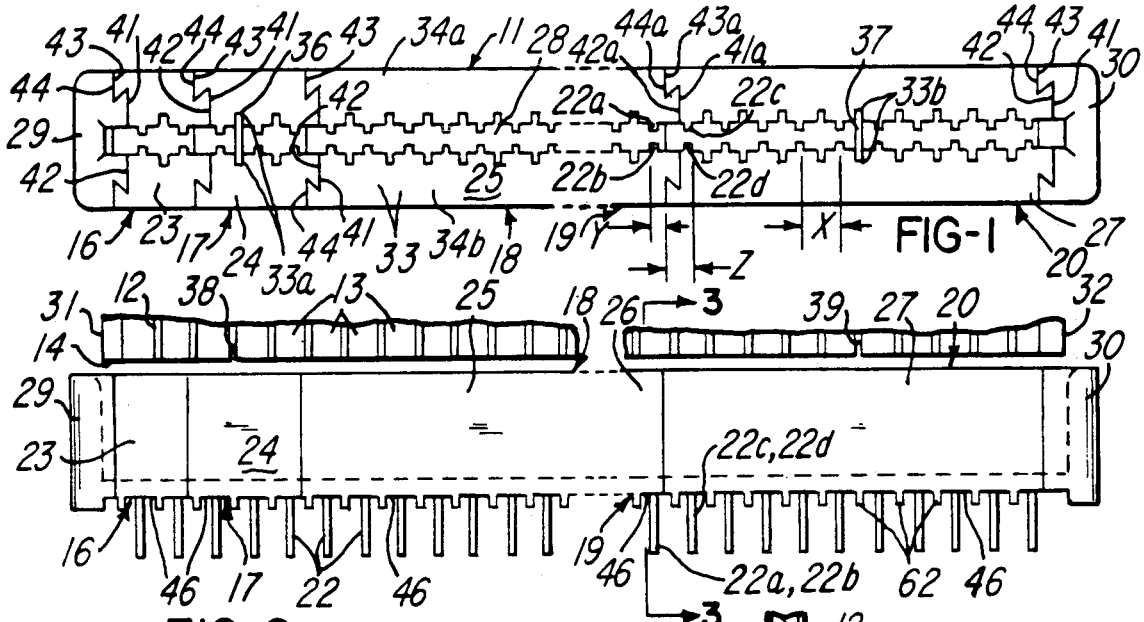
FIG. 1 is a top view of a multi-contact, multi-module connector according to this invention.
Figure 2:
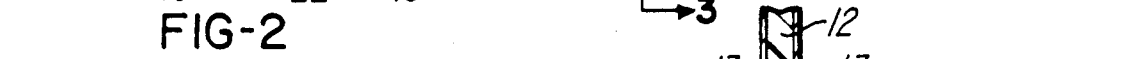
FIG. 2 is a side view of the connector in FIG. 1.

FIGS. 1 and 2 show several modules connected together to form a multi-contact electrical connector 11 to receive a printed circuit board 12 or any similar male connector structure having connector pads, or fingers, 13 evenly spaced along one or both surfaces adjacent one edge 14. The reference numeral 13 will be used to refer to any of the fingers in general; when reference is made to specific fingers, letter suffices will be added, and this same practice will also be followed for other components that occur in multiple form in the following description.

The connector 11 includes an assembly of modules 16–20 that have contacts 22 arranged with the same uniform spacing as the fingers 13 to make electrical connection with them. The contacts are held in insulating support members 23–27 molded of thermoplastic material that has excellent dimensional stability and electrical insulating characteristics and is not adversely affected by the heat of molten solder. A material suitable for this purpose is a 30% glass-filled polyester material. The modules 16–20 have different numbers of contacts 22 placed, in this embodiment, in mirror-image pairs on opposite sides of a central slot 28, which will be referred to as the connector-receiving slot, or the main slot. To make it possible for the connector 11 to have any desired number of contacts or contact pairs, the module 16 has two pairs of contacts and the module 17 has three pairs. In theory, a connector having any number of contacts could be assembled using appropriate numbers of modules 16 and 17, but as a practical matter, the unavoidable small differences in the lengths of modules that are supposed to have the sam nominal length make it preferable to limit the total number of modules in a connector to about seven, although that number is only an illustrative number and is not to be considered a limitation of this invention. At the same time, it is desirable not to have too many different sizes of modules. By having modules with ten contact pairs as well as modules with two and three contact pairs, a connector having almost any number from two through sixty-three contact pairs can be assembled using not more than seven modules. There are no occasions requiring only a single contact or contact pair and few, if any, requiring less than four, so it is not necessary to provide a module that has only a single contact pair. Although the modules 18 and 19 in the connector 11 are only partially shown, it will be assumed that each of them is a ten-pair module.

The connector 11 also includes two end members 29 and 30 that engage the edges 31 and 32 of the printed circuit board 12 to help guide the board into position within the main slot 28. In order to prevent the board from being inserted backward in the main slot, the modules 16–20 have small polarization slots, or keyways, 33 arranged in juxtaposed pairs in side walls **34*a* and 34*b* that define the sides of the main slot 28. The board 12 can be restricted to allow it to be inserted into the slot 28 in only one orientation by placing one or more keys 36 and 37 in keyways 33*a* and 33*b* assymetrically located with respect to the end members 29 and 30 and cutting slots 38 and 39 at corresponding, assymetrical positions relative to the edges 31 and 32. The board 12 could then be inserted into the slot 28 only if all four of the guiding means on it, i.e., the two edges 31 and 32 and the slot 38 and 39, were properly related to the corresponding guiding means on the connector, i.e., the end members 29 and 30 and the keys 36 and 37**.

One assymetrically placed key and slot would be sufficient, but two or more keys provide better balance for a board 12 that has a long edge 14. With three or more keys, it would not even be necessary to have the end members 29 and 30 to guide the edges 31 and 32. Moreover, while one set of keyways 33, such as the two-pair module 16 has, would be sufficient for all modules, having a pair of keyways between each pair of contacts 22, except at one end of the modules, makes it easier to select coding key and slot locations that do not interfere excessively with the operation of circuits on the board 12.

The modules 16–20 and the end members 29 and 30 are held together by dovetail-shaped projections 41 on one end of each module and on the end member 29 that fit into conversely shaped recesses 42 in the adjacent module and in the end member 30.

The unit distance between each of the contacts 22 and the next adjacent one is indicated by the value X in FIG. 1, and in keeping with a fundamental object of this invention, it is essential that the distance X remain virtually constant across each module-to-module interface, for example, from the module 19 to the module 20. To maintain the unit distance spacing constant across that interface, the end of the module 19 that has the dovetail-shaped projection **41*a* also has a bearing, or gauging, surface 43*a*, and the abutting end of the module 20 that has the dovetail-shaped recess 42*a* also has a bearing, or gauging, surface 44*a*. Similar bearing surfaces are provided on all of the modules. The projections 41 and the recesses 42 fit so tightly together that, when assembled to form the connector 11, they draw the bearing surfaces 43 and 44 firmly against each other. Thus, it is those bearing surfaces that determine the exact spacing between the contacts in different modules, as illustrated by the contacts 22*a* and 22*b* in the module 19 and the contacts 22*c* and 22*d* in the module 20. This further requires that the unit distance X be exactly equal to Y plus Z, where Y is the distance from the bearing surface 43*a* to the central plane of the next contact pair 22*a* 22*b* to the left of the surface 43*a* and Z is the distance from the surface 44*a* to the central plane of the next contact pair 22*c*. 22*d* to the right of the surface 44*a*.**

In this embodiment, the projections 41 happen to extend beyond their respective bearing surfaces 43 very slightly less than one-third of the longitudinal distance X, and the longitudinal depth of each of the recesses 42 is made very slightly greater than one-third of the distance X, so that all parts of these conversely shaped interlocking means are between the two adjacent contact pairs **22*a*, 22*b* and 22*c*, 22*d*. This forms a good interlocking relationship between modules, but a broader definition of the relationship between the parameters X, Y, and Z is that the distance Y between the bearing surface 43 and the central plane of the nearest contact 22 in the same module and in the direction toward the far end thereof, plus the distance Z between the bearing surface 44 and the central plane of the next contact 22** in the same module and in the direction toward the far end thereof is equal to an integral multiple n of the unit distance X. In fact, it is understood in the industry that such measurements are made to the central plane or to comparable parts of two contacts, and it is sufficient to say that Y or Z is the distance between the respective bearing surface and the next adjacent contact toward the far end of the same module.

It will be noted in FIG. 2 that one end of each of the contacts 22 extends below the bottom surface 46 of the insulating support members 23–27 that make up the largest part of the connector 11. These downwardly extending ends are all neatly aligned, which makes it easy to insert them into similarly aligned holes 45 in a support member, such as a mother board 47, a small fragment of which is shown in FIGS. 3 and 4.

Figure 3:
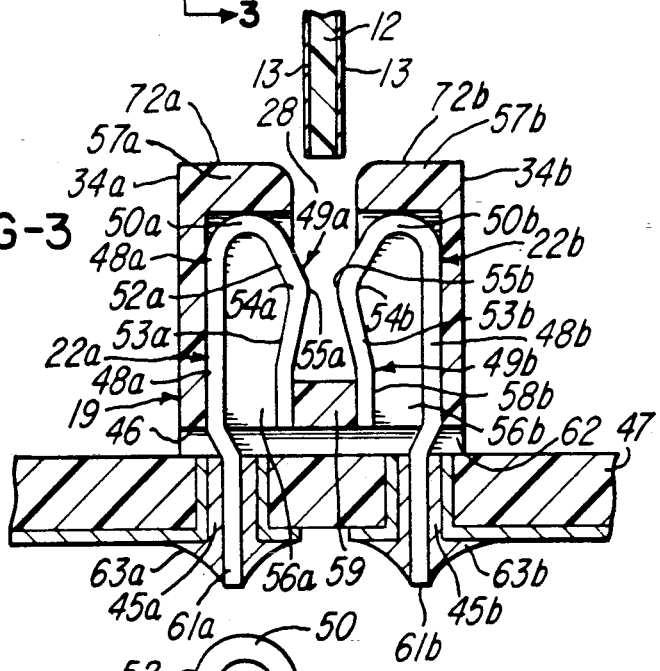
FIG. 3 is a cross-sectional view of the connector in FIGS. 1 and 2 taken along the line 3—3 in FIG. 2.
Figure 4:
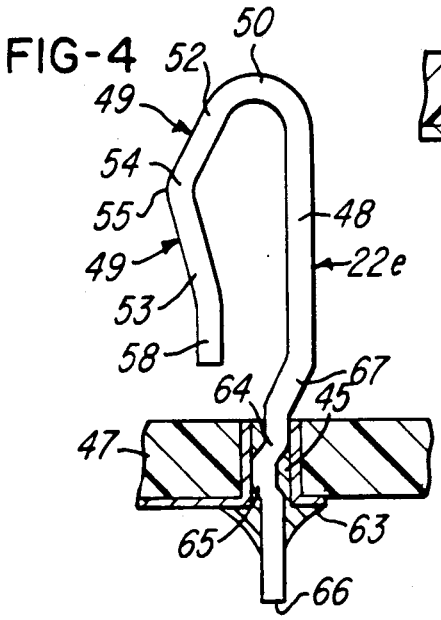
FIGS. 4 and 5 show alternative embodiments of the wire contact clip shown in FIG. 3.
Figure 5:
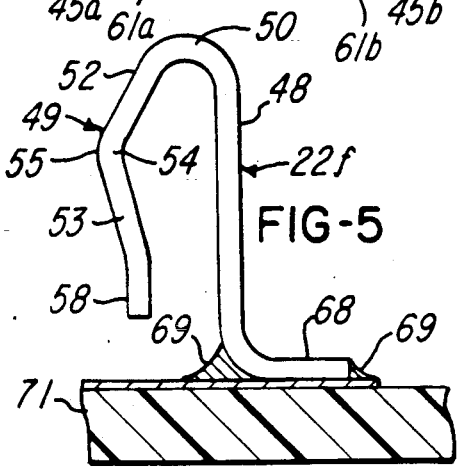

FIGS. 3, 4, and 5 show three different embodiments of wire contact clips suitable for use as the contacts 22 in FIG. 1. The contacts 22*a* and 22*b* in FIG. 3 have the same configurations of their upper portions as the contact 22*e* in FIG. 4 and the contact 22*f* in FIG. 5: a relatively straight part 48, which will be referred to as the main part; a bent or curved or bowed part 49; and a loop or bight 50 that joins the upper end of the main part to the upper end of the bent part 49. The bent part 49 in these embodiments includes upper and lower sections 52 and 53, with a relatively sharp bend 54 between them, and it is the convex surface 55 of that bend that is the contact area that engages the respective finger 13 on the printed circuit daughter board 12. Making the bend 54 relatively sharp limits the lateral extent of the surface area that can press against the finger and thus produces excellent engagement, of a quality that is known in the industry as gastight, between the contact area 55 and the finger 13. The term "gastight" refers to the fact that the unit pressure of the contact area on the finger is so high—on the order of 100,000 p.s.i.—that no other substances, even gas, can remain between them but will be wiped out of the way, even though the direct spring pressure furnished by the resilience of the contacts 22 is only of the order of ten ounces.

The contacts 22*a* and 22*b* in FIG. 3 are located in contact slots 56*a* and 56*b*, respectively, within the side walls 34*a* and 34*b*. The height of these slots, or to put it another way, their depth of penetration upwardly into the side walls, is a little less than the height of the side walls so that there is a cover 57*a* and 57*b* over each of the contact slots 56*a* and 56*b*, respectively, that limits the extent of insertion of the contacts 22 into them. The covers over all of the contact slots keep all of the contacts in very nearly the same position and help keep them in alignment. In addition to height, the contact slots have two other dimensions: width in the direction perpendicular to the plane of the drawing, which is also the longitudinal direction of the module; and depth in the direction perpendicular to the main slot 28. The depth of each contact slot 56 is a little less than the thickness of the side wall 34 in which it is formed, so that the outer side of each contact slot is bounded by a thin part of the side wall, but the inner side of each contact slot is open to the main slot 28 to communicate with it. In order for each contact 22 to make connection with one of the fingers 13, the bent part 49 of the contact must protrude through the open side of its contact slot into the main slot. It will be noted in FIG. 3 that the main part 48 of each contact is pressed against the inwardly facing surface of the thin part of its respective side wall 34 and that the perpendicular distance from that inwardly facing surface to the contact area is greater than the depth of the slot 56. Even before the contacts 22 are soldered in the holes 45, they are held in the positions shown in the contact slots 56 by resilient pressure of the free ends 58 against a central portion 59 of the lower part of the insulating support member 26. This central portion is the same width as the main slot 28, and, therefore, it also defines the depth of the contact slots 56 by forming all that remains of the inner sides of those slots. The central portion is also a bridging portion that joins the lower edges of the side walls 34*a* and 34*b* together to give the insulating support member 26, as well as the module 19, itself, a U-shaped crossection when viewed from one end, as in FIG. 3.

The depth of each contact slot is sufficient to allow one of the contacts to he inserted between the central portion 59 and the thin part of the side wall 34 without having to force the free end 58 so far toward the main part 48 that the bight goes past its point of resilient recovery and becomes permanently bent more than it is supposed to be. It is important that the bight and the upper section 52 of the bent part 49 not be overstressed, because those are the parts that provide the resilient force to press the contact area 55 against the finger 13 when the printed circuit board 12 is in the slot 28.

The lowermost end 61 of the contact 22, which is the part held in the solder 63 in the hole 45, is offset from straight alignment with the main part 48. This is done to allow the ends 61*a* and 61*b* to be aligned with the holes 45*a* and 45*b* that have axes 0.200" apart, a standard distance for mounting holes in the printed circuit industry, while the axes of the main parts 48*a* and 48*b* are about 0.250" apart. The reason that the main parts cannot simply be allowed to be closer together is that the resilience of the bight is an important part of the force pressing the contact area 55 against one of the fingers 13, as stated previously, and so must not be lost by having the bight bent too sharply. The radius of curvature of the bight 50 should preferably be at least about as great as the diameter of the wire of which the contact 22 is formed but must not be so great that, in order to accommodate it, the width of the insulating member 26 would have to be excessive. For a beryllium copper contact wire having a diameter of about 0.020", the bight preferably has a radius of about 0.025", which may be formed by bending the wire around a mandrel that has a diameter of about 0.050". The overall direct distance from the contact area 55 to the inner surface of the thin wall section of the side wall 34 is about 0.118" to about 0.122".

In addition, the distance between the two contact areas 55*a* and 55*b* must be somewhat less than the thickness of the printed circuit board 12, which is nominally about 0.062" but which may be as thin as 0.054" or as thick as 0.071" without being out of tolerance. A satisfactory spacing between the contact areas 55*a* and 55*b* before the board 12 is inserted is about 0.028" to about 0.032", which, with the aforementioned dimensions, places the axes of the main parts 48 about 0.250" apart. Hence it is necessary to offset the end 61 of each contact 22 about 0.025" toward the bent part 49 to allow the two ends 61*a* and 61*b* to be spaced about 0.200" apart, center-to-center.

All of the foregoing dimensions are based on the use of certain standard materials, and they should not be considered as limiting the scope of the invention, since the modules described herein may be used with other materials or components of generally similar structure.

FIGS. 2 and 3 show low barriers 62 extending downwardly from the bottom surface 46 of the insulating support members 16–20 between each pair of contacts 22. These barriers separate the bottom surface from the mother board 47 and prevent a wicking action by which the solder 63, when it is molten and is filling the holes 45 to hold the ends 61 in place, may travel up the connector wire and enter the contact slots 56, possibly even bonding the free end 58 to the main part 48.

The only difference between the contacts 22*a* and 22*b* in FIG. 3 and the contact 22*e* in FIG. 4 and the contact 22*f* in FIG. 5 is in their lowermost parts. The ends 61 in FIG. 3 are straight from the offset on down. The contact 22*e* in FIG. 4 is identical to contacts described and claimed in the U.S. copending application Ser. No. 596,096 of Minter, and it has two offsets 64 and 65 in opposite directions between the bottom end 66 and a third offset 67 that provides the 0.025" offset discussed in connection with FIG. 3. The offset 64 stabilizes the connector 22*e* against cold flow of the solder 63, and the offset 65 aligns the bottom end 66 with the hole 45, as described in the Minter U.S. application Ser. No. 596,096.

The lower end of the connector 22*f* in FIG. 5 is bent at approximately a right angle to the main part 49 and is slightly flattened to serve as a soldering tab 68. This tab is held by solder 69 on the upper surface of a mother board 71 and does not need to be inserted in a hole in that board. When the contact 22*f* is used in the insulating support member 26 in FIG. 3, the tab extends out to the side through a channel bounded by the mother board, the bottom surface 46 of the support member 26, and two of the barriers 62.

It will be noted in FIG. 1 that all of the support members 23–27 have keyways between each pair of contacts 22 and the next pair but no keyway between the last contact and the end that has the projection 41 or the end that has the recess 42. The reason is that a keyway at either of those locations would intersect the projection 41 or the recess 42 or both and might weaken the structure at that point. This slightly reduces the number of locations at which a key 36 or 37 could be placed, but it is not a serious matter. For one thing, until the connector 11 is soldered onto its support member, it could be turned around so that the male end member 29 would be on the right and the female end member 30 on the left. This is permissible since the contacts 22 are identical on both sides of the main slot 28. Alternatively, or in addition, the sequence of the modules 16–20, i.e., two-pair, three-pair, ten-pair, ten-pair, ten-pair, could be permutated in any order as the modules were being connected together to form the connector 11.

FIGS. 6–10 are particularly prepared for the ten-pair insulating support member 26, but they are essentially applicable to the two-pair and three-pair members 16 and 17 in FIGS. 1 and 2 as well. The main slot 28 extends entirely through the support member 26, including the projection 41, and the two side walls 34*a* and 34*b* are connected together by the central portion 59 and the barriers 62. The central portion not only limits the extent that a daughter board could be inserted into the slot 28 but is an uninterrupted link between the side walls along the whole length of the main part of the insulating support member 26. However, the central portion does not extend under the projection 41, which is thus divided into two mirror-image sections 41*a* and 41*b*. The dovetail-shaped recess 42 may also be considered as being divided into two parts 42*a* and 42*b*.

Figure 6:
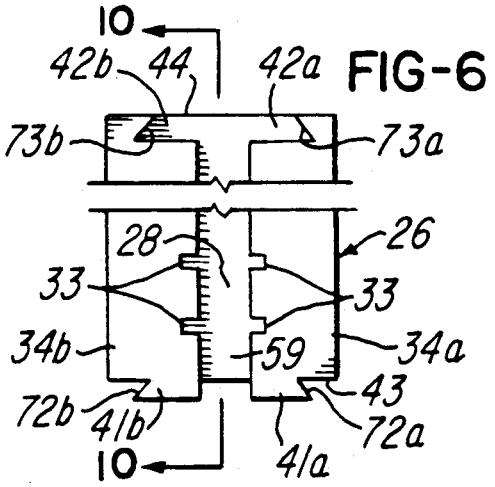
FIG. 6 is a top view of one of the insulating support members in FIGS. 1 and 2.

As shown in FIG. 6, the projection sections 41*a* and 41*b* have slanting sides 72*a* and 72*b* that are equally spaced apart on opposite sides of the central longitudinal plane of the slot 28. These sides intersect the bearing surface 43 at acute angles of about 45° in this embodiment, and they define a neck across the narowest part of the projection, which is the part between the intersection of the slanting side 72*a* with the bearing surface 43 and the intersection of the slanting side 72*b* with the bearing surface. Since the recess 42 is conversely shaped with respect to the projection 41, it naturally has two slanting sides 73*a* and 73*b* that intersect the bearing surface 44 at acute angles that are the same as the angles between the sides 72*a* and 72*b* and the bearing surface 43. Furthermore, the sides 73*a* and 73*b* are spaced apart on opposite sides of the central longitudinal plane of the slot 28 in the same way as the slanting sides 72*a* and 72*b*. The slanting sides 73*a* and 73*b* define a neck at their intersections with the bearing surface 44, and in order that the recess 42 hold the projection 41 firmly, the width of the neck of the projection is equal to the width of the neck of the recess.

In order for the two bearing surfaces of the interlocking modules to press against each other, the height of the projection 41, as measured in the longitudinal direction of the insulating support member 26, must not he any greater than the depth of the recess 42, as measured in the same direction, and is preferably a little less. For example, if the height of the projection 41 is 0.030", the depth of the recess 42 should preferably be about 0.035".

The bearing surface 43 may be considered as on end surface of the main portion of the insulating support member 26, even though the dovetail-shaped projection 41 extends beyond it. It is easier to recognize that the other bearing surface 44 is, in every sense, the other end surface of the insulating support member 26. Both of the bearing surfaces 43 and 44 are perpendicular to the longitudinal direction of the support member 26.

Figure 7:
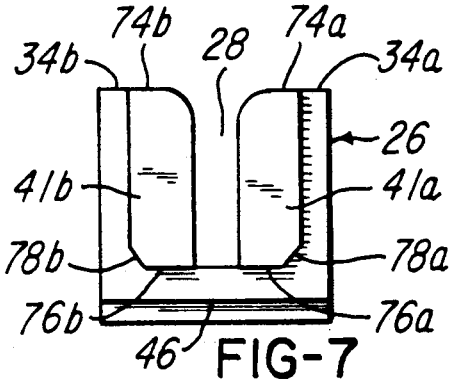
FIG. 7 is an end view of one end of the support member in FIG. 6.
Figure 12:
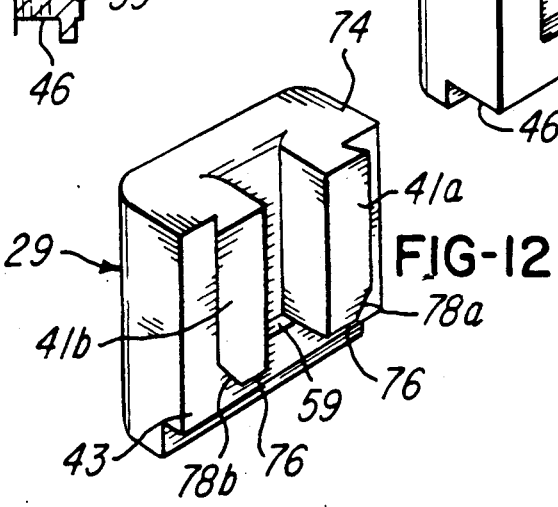
FIG. 12 is a perspective view of a male end member of the connector in FIG. 1.

FIG. 7 shows one end view of the support member 26 with the two sections 41*a* and 41*b* of the projection 41 extending part of the way across the end, or bearing surface, 43 from the top surface 74 of the support member toward the bottom surface 46 thereof. FIG. 12 shows identical projection sections 41*a* and 41b and the bearing surface 43, and that figure may make the relationship of these parts more clear by showing them in perspective. The projection 41 is actually a slide that has a dovetail-shaped cross section. As a slide, its longitudinal direction, which is defined as the direction along which its cross section remains constant in area and shape, is the vertical direction in FIG. 7. That is also the direction in which a daughter board would normally be inserted into the main slot 28. The end 76 of the projection 41 closer to the bottom surface 46 of the support member 26 is coplanar with the top surface of the central portion 59 of the bottom wall. All that remains of the end surface of the member 26 to form the bearing surface 43 is a U-shaped portion bordering the two outer, longitudinal sides of the sections 41*a* and 41*b* and extending across the support member 26 below the two parts 76*a* and 76*b* of the end surface of the projection 41. However, by making the area of the U-shaped surface 43 greater than about one-third of an area having the height and width of the end of the support member, and preferably half as great as, or even greater than half as great as, an area so measured, and preferably by having the bearing surface extend to the perimeter of a surface so measured, the bearing surface will be able to maintain stability of engagement between the interlocked members.

Figure 11:
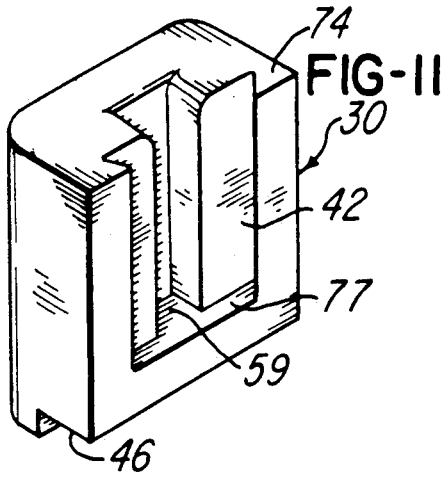
FIG. 11 is a perspective view of a female end member of the connector in FIG. 1.

The recess 42 also has a cross section that remains constant in area and shape along a longitudinal direction parallel to the longitudinal direction of the projection 41. The configuration of the recess 42 can best be seen in the end member 30 in FIG. 11, in which it has exactly the same shape as in the insulating support member 26. Like the projection 41, the recess 42 extends only part of the way down the end of the support member or of the end member 30, from the top surface 74 to a floor 77 coplanar with the top surface of the central member 59. The fact that the recess 42 has the same longitudinal dimension as the projection 41 means that, when the projection 41 is inserted longitudinally into the recess 42 on another insulating support member or end member 30 until the end surface 76 of the projection 41 strikes the floor 77, the top surface 74 of both such interlocked members will be coplanar.

The dimensions of the bearing surface 44 adjacent the recess 42 in the embodiment illustrated in the drawings are exactly the same in size and shape to those of the bearing surface adjacent the projection 41. As a specific example, but one that is not to be considered as limiting the scope of this invention, insulating support members, such as the member 26, have been made with an overall width of 0.350" and a height from the bottom surface 46 to the top surface 74 of 0.320". The overall area of the end surface of the insulating member would, therefore, be 0.112 sq. in., if part of that area were not lost due to the main slot 28. The width of the neck of the recess 42 (and of the projection 41) in such a supporting member is 0.212", and the length from the top surface 74 to the floor is 0.270". Thus, the cross-sectional area of the bearing surface 44 (and of the bearing surface 43) is the difference between these areas, or 0.05476 sq. in., which is only a little less than half of the area defined by the height times the width of an end of the insulating support member 26.

Figure 8:
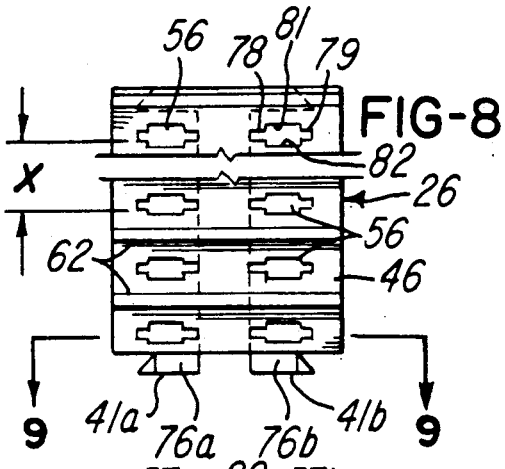
FIG. 8 is a bottom view of the support member in FIG. 6

FIG. 8 shows the configuration of the openings of the contact slots 56 at the bottom surface 46 of the insulating support member 26. The innermost and outermost portions 78 and 79 of each contact slot are just wide enough, in the longitudinal dimension of the member 26, to allow one of the contacts 22 of FIGS. 3–5 to fit into them without binding. For contacts made of 0.020" wire, the width of the innermost and outermost parts 78 and 79 may be 0.021". The reason for making the spacing between the wall portions 81 and 82 at the central part of the contact slots 56 greater than the width of the parts 78 and 79 is to allow stronger pieces to be used in the mold in which the insulating support member 26 is molded.

Figure 10:
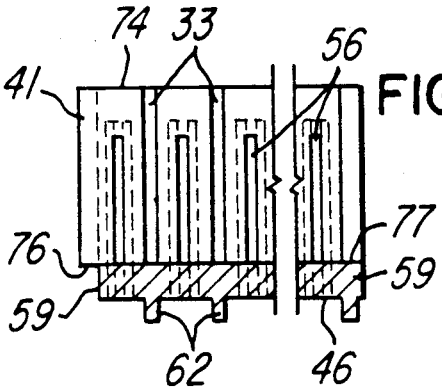
FIG. 10 is a cross-sectional view of the support member in FIG. 6 taken along the line 10—10 in FIG. 6.

FIGS. 8 and 10 show that the contact slots 56 are evenly spaced apart in the longitudinal direction of the member 26 by a distance X that corresponds to the spacing between adjacent fingers 13 on the printed circuit board 12 in FIG. 1 and that the barriers 62 are spaced so that they are midway between each pair of contact slots.

FIG. 10 also makes it clear that each of the keyways 33 is directly over one of the barriers 62, with the result that any downward force on a key in any keyway would be absorbed by the barrier 62 under that keyway and would be directly transmitted to the support member on which the member 26 was mounted.

Figure 9:
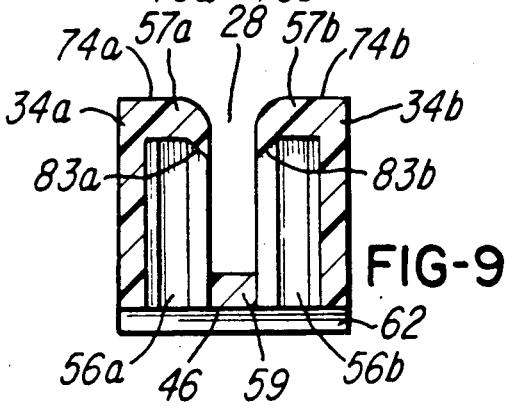
FIG. 9 is a cross-sectional view of the support member in FIG. 6 taken along the line 9—9 in FIG. 8.

FIG. 9 shows that the depth of the contact slots is uniform from the bottom surface 46 to the underside of the cover 57, except for a small sloping portion, or barrier, 83 at the lower surface of the cover 57 and at the edge thereof adjacent &he main slot 28. The reason for the small barrier 83 is to prevent, or at least limit, movement of the uppermost part of the contact 22. In FIG. 3, that part is shown to be the bight 50. No such small barriers are shown in that figure, and prior to insertion of the lowermost ends 61 of the contacts 22 into the holes 45, it would be possible for the ends **61*a* and 61*b* to be spread apart, thereby misaligning them for insertion into the holes 45. Such movement, which would obviously be undesirable, could occur inadvertently if pressure were put on one or more of the lowermost ends 61 in a direction to pivot that end or those ends outwardly, but such pivoting motion, which would take place about the central portion 59 of the bottom wall, would result in displacing or tilting the upper part of the contact 22 toward or into the slot 28. The small barriers 83 help prevent the upper portion of the contact 22 from being displaced and thus help prevent the lowermost ends 61 from being displaced outwardly, away from alignment with the holes 45. Since the spaces occupied by the barriers 83 in FIG. 9 are empty in FIG. 3, molding the upper part of each contact slot 56 to include such a barrier will not adversely affect the proper insertion of the contacts 22 into the respective contact slots 56, since, unlike most printed circuit board edge connectors, the contacts 22 are inserted through the openings at the bottom surface of the support member 26. The covers 57 not only limit the extent to which the contacts can be pushed up into the contact slots 56, but they also protect the contacts from above when the connector 11 is in use. Most, if not all, edge connectors on the market have contacts that are inserted from above. In such connectors, it is the upper end of each contact slot that must be wide open to receive the contact, thereby leaving the contacts exposed to having other things, such as screwdrivers and probes inserted into the contact slots along with them. The fact that the small barriers 83 are located in a corner of each of the slots that would otherwise be vacant also means that these barriers will not adversely affect proper operation of the contacts 22 in receiving a printed circuit board 12**.

What is claimed is:

1. A modular electrical connector structure comprising:

(a) first and second side walls and a bottom wall molded of insulating material to form an insulating support member having top and bottom surfaces, and first and second ends spaced apart in a first, or longitudinal, direction;

(b) a projection extending from the first end and comprising a first slide extending across the first end and having a dovetail-shaped cross section with predetermined dimensions;

(c) a recess in the second end comprising a second slide extending across the second end parallel to the first slide and having a cross-sectional shape that is the complement of the cross-sectional shape of the first slide, whereby the first slide, if on a different such support member, would interlock firmly with the second slide;

(d) first and second bearing surfaces adjacent the first and second slides, respectively, and facing in longitudinally opposite directions;

(e) a plurality of contact locations evenly spaced a unit distance apart along the longitudinal direction of the support member, the longitudinal distance from the first bearing surface to the next-adjacent one of the contact locations in the direction toward the second end of the support member plus the longitudinal distance from the second bearing surface to the next-adjacent one of the contact locations in the direction toward the second end of the support member being equal to the unit distance.

2. The structure of claim 1 in which the slides start at the top surface of the support member and extend to a common level part of the way toward the bottom surface thereof.

3. The structure of claim 1 in which the distance the first and second slides extend across the respective ends is less than the total distance thereacross.

4. The structure of claim 3 in which both of the slides start at one surface of the support member and the first slide terminates at an end surface thereof and the second slide terminates at a floor coplanar with the end surface of the first slide.

5. The structure of claim 1 in which the first and second side walls are spaced apart to define a main slot therebetween extending the entire longitudinal distance of the support member.

6. The structure of claim 5 in which the contact locations comprise contact slots extending into the side walls in juxtaposed pairs, each of the contact slots communicating with the main slot.

7. The structure of claim 6 comprising, in addition, resilient contacts in the contact slots, each of the contacts comprising a portion that protrudes resiliently into the main slot.

8. A modular electrical connector structure comprising:

(a) an insulating support member comprising first and second side walls and a bottom wall, top and bottom surfaces, and first and second ends spaced apart in a first, or longitudinal, direction;

(b) a projection extending from the first end and having a cross section with predetermined dimensions and extending laterally in a second direction across the first end, the cross-sectional dimension of the projection perpendicular to the longitudinal direction being smaller at a location adjacent the first end than at a location longitudinally spaced from the first end;

(c) a recess extending into the second end and having a cross section conversely shaped with respect to the cross section of the projection with dimensions compelementally matching the predetermined dimensions of the projection and extending laterally in the second direction, whereby the projection, if on a different such support member, would interlock firmly longitudinally with the recess;

(d) first and second bearing surfaces adjacent the projection and the recess, respectively, and facing in longitudinally opposite directions;

(e) a plurality of contact locations evenly spaced a unit distance apart along the longitudinal direction of the support member, the longitudinal distance from the first bearing surface to the next-adjacent one of the contact locations in the direction toward the second end of the support member plus the longitudinal distance from the second bearing surface to the next-adjacent one of the contact locations in the direction toward the second end of the support member being equal to an integral multiple of the unit distance.

9. The structure of claim 8 in which the integral multiple is 1..

10. The structure of claim 8 in which the ends of the support member are perpendicular to the longitudinal direction thereof and the first and second bearing surfaces comprise portions of the first and second ends, respectively.

11. The structure of claim 10 in which the projection and the recess are adjacent the top surface, and the first bearing surface extends on each side of the projection and between the projection and the bottom surface, and the second bearing surface extends on both sides of the recess and between the recess and the bottom surface.

12. The structure of claim 8 in which the side walls are spaced apart in a second direction perpendicular to the first direction to define a main slot therebetween open at the top surface and at each of the ends and closed by a central portion of the bottom wall, the contact locations comprising slots extending into the side walls and opening into the main slot in juxtaposed pairs.

13. The structure of claim 12 in which the slots extending into the side walls are contact slots and they extend into the side walls from the bottom surface of the support member.

14. The structure of claim 13 comprising, in addition, bent wire contacts resiliently held in the contact slots.

15. The structure of claim 14 in which one end of each of the wire contacts extends below the bottom surface of the support member and a portion of each of the wire contacts within its respective contact slot bears resiliently against a surface of the support member to retain said end of that contact in alignment with the corresponding end of the other contacts.

16. The structure of claim 15 comprising barrier means between the main slot and the portion of each contact slot closest to the top surface of the support member to prevent that portion of each of the contacts from being pivoted toward the main slot.

17. The structure of claim 16 in which the main member of each contact comprises a first portion within the respective contact slot and substantially perpendicular to the bottom surface thereof and a second portion outside of the support member and bent to extend substantially parallel to the bottom surface of the support member and away from the bent member.

18. The structure of claim 15 in which the wire contacts are generally J-shaped and comprise a main member terminating in said one end, a bent member protruding into the main slot, and a bight joining the bent member to the main member.

19. The structure of claim 18 in which the main member of each contact comprises a first portion within the respective contact slot and substantially perpendicular to the bottom surface thereof and a second portion outside of the support member and extending in the same direction as the first portion of the main member but laterally offset therefrom in the direction toward the bent member.

20. The structure of claim 14 in which the support member comprises a plurality of barriers extending from the bottom surface of the support member and parallel to the ends of the support member, each of the barriers being between two pairs of the slots extending into the side walls.

21. The structure of claim 20 in which one end of each of the contacts extends below the bottom surface of the support member and is bent to extend substantially parallel to said bottom surface and not to extend farther from said bottom surface than each of the barriers does.

* * * * *